US008303095B2

(12) United States Patent
Rutten et al.

(10) Patent No.: US 8,303,095 B2
(45) Date of Patent: Nov. 6, 2012

(54) INK SUPPLY ASSEMBLY FOR AN INK JET PRINTING DEVICE

(75) Inventors: Hendrik G. J. Rutten, Arcen (NL); Hans Reinten, Velden (NL)

(73) Assignee: Oce-Technologies B.V., Venlo (NL)

( * ) Notice: Subject to any disclaimer, the term of this patent is extended or adjusted under 35 U.S.C. 154(b) by 894 days.

(21) Appl. No.: 12/289,191

(22) Filed: Oct. 22, 2008

(65) Prior Publication Data

US 2009/0102899 A1 Apr. 23, 2009

(30) Foreign Application Priority Data

Oct. 23, 2007 (EP) ..... 07119087

(51) Int. Cl.
*B41J 2/175* (2006.01)

(52) U.S. Cl. ..... 347/85

(58) Field of Classification Search ..... 347/85
See application file for complete search history.

(56) References Cited

U.S. PATENT DOCUMENTS

| | | | | |
|---|---|---|---|---|
| 6,010,211 | A * | 1/2000 | Betschon | 347/86 |
| 6,692,113 | B2 | 2/2004 | Silverbrook et al. | |
| 6,830,325 | B2 * | 12/2004 | Hirota et al. | 347/94 |
| 7,097,293 | B2 * | 8/2006 | Ichihashi et al. | 347/86 |
| 2003/0067520 | A1 * | 4/2003 | Inoue et al. | 347/86 |
| 2005/0140754 | A1 * | 6/2005 | Hirota et al. | 347/85 |
| 2006/0007272 | A1 | 1/2006 | Ogata et al. | |

FOREIGN PATENT DOCUMENTS

| | | | |
|---|---|---|---|
| EP | 0 972 643 | A2 | 1/2000 |
| EP | 1 285 761 | A1 | 2/2003 |
| EP | 1 547 775 | A1 | 6/2005 |
| EP | 1 658 978 | A1 | 5/2006 |
| EP | 1 849 605 | A2 | 10/2007 |
| JP | 7-137262 | A | 5/1995 |

* cited by examiner

*Primary Examiner* — Charlie Peng

(74) *Attorney, Agent, or Firm* — Birch, Stewart, Kolasch & Birch, LLP

(57) ABSTRACT

An ink supply assembly includes at least one inlet port. At least one outlet port is connected to the inlet port via an ink cavity and is adapted to be connected to an ink discharge unit of an ink jet device. The ink supply assembly has a sandwich structure formed by at least two plate members and a foil that is interposed therebetween and has a part forming a wall of said ink cavity. At least one of the plate members defines a pressure equalization chamber adjacent to the ink cavity and separated therefrom by the foil.

16 Claims, 9 Drawing Sheets

INK SUPPLY ASSEMBLY FOR AN INK JET PRINTING DEVICE

CROSS-REFERENCE TO RELATED APPLICATIONS

This application claims priority under 35 U.S.C. §119(a) to Application No. 07119087.0, filed in Europe on Oct. 23, 2007, the entirety of which is expressly incorporated herein by reference.

BACKGROUND OF THE INVENTION

1. Field of the Invention

The present invention relates to an ink supply assembly including at least one inlet port, at least one outlet port connected to the inlet port via an ink cavity and adapted to be connected to an ink discharge unit of an ink jet device. The assembly has a sandwich structure formed by at least two plate members and a foil that is interposed therebetween and has a part forming a wall of the ink cavity. At least one of said plate members defines a pressure equalization chamber adjacent to the ink cavity and separated therefrom by said foil.

2. Description of Background Art

A known ink supply assembly of this type has been described in EP-A-1 658 978. Another known ink supply assembly has been described in U.S. Pat. No. 6,692,113 and is used for a page wide ink jet printhead. The ink discharge units of this printhead are formed by chip-like micro-electro-mechanical systems (MEMS), each of which forms a plurality of nozzles and associated actuators for creating and expelling ink droplets through the nozzles. The chips are butted against one another so as to form a continuous line extending over the entire width of the printing medium and are tiled such that they define a continuous nozzle array with uniform nozzle pitch, even at the boundaries between adjacent MEMS. In a color printer, a separate nozzle array is provided for each of the different colors.

The purpose of the ink supply assembly is to distribute the ink of the various colors into the nozzles of all the MEMS of the printhead. The ink supply system in its entirety may be composed of a plurality of ink distribution tiles that are butted against one another and each of which serves a plurality of MEMS. In the known design, each ink distribution tile is composed of two plate members, e.g. micro-moldings that are made of liquid crystal polymer (LCP), that are bonded together face-to-face with the foil that is made of polyimide, for example, being interposed therebetween. The inlet ports for the ink of different colors are formed in the top plate member, and the outlet ports are formed in the bottom plate member. Ink passages are formed by the cavities formed in the plate members on either side of the foil and by through-holes in the foil. The cavities and the through-holes are arranged such that the ink passages for different colors are separated from one another.

SUMMARY OF THE INVENTION

It is an object of the present invention to provide an ink supply assembly that has a compact and simple construction and permits an improved image quality of the ink jet printing device.

In order to achieve this object, the ink supply assembly according to the present invention has an ink cavity that includes an ink passage, which connects the inlet port to the outlet port. An ink chamber is in communication with the ink passage via a flow restriction and forms a dead end in the ink flow. The foil separates the ink chamber from the pressure equalization chamber.

The ink chamber and the flow restriction, together with the foil and the pressure equalization chamber, will function as a damper for attenuating pressure oscillations. The part of the foil separating the ink chamber from the pressure equalization chamber may flex into this latter chamber so as to absorb pressure fluctuations that may occur in the liquid ink. For example, such pressure fluctuations may be induced, especially in a page wide printer, when a large demand for ink occurs in a certain region of the printhead because almost all nozzles in that region are firing. Then, in order to replace the ink that has been consumed, fresh ink must flow towards that region of the printhead, so that a relatively rapid flow of ink is induced. When the demand for ink ceases abruptly, this will create a pressure surge that may influence the drop forming characteristics and hence the print quality.

Moreover, when the printhead is moved relative to the frame of the printer, the accelerations and decelerations of the printhead and the mass or inertia of the liquid ink may also give rise to pressure fluctuations. It should be noted here that even in case of a page wide printhead it may be useful or necessary to provide for a slight oscillating movement of the printhead, e.g. in order to improve the spatial resolution of the printer.

The present invention has the advantage that such pressure fluctuations that would have an adverse effect on the print quality can easily and efficiently be attenuated by the action of the foil and the pressure equalization chamber, i.e. by a structure that is integrated in the ink supply assembly and therefore hardly requires any additional space within the printhead.

The plate members may be made of LCP or LTCC (low temperature co-fired ceramic) or, preferably, of graphite. The cavities, ports and other structures in the plate members may be formed by suitable machining techniques, e.g. laser cutting, or by molding techniques, depending on the type of material being used.

The flow restriction may be so dimensioned that critical damping is achieved in the predominant frequency range of the pressure oscillations. It is particularly preferred that the flow restriction is formed by a through-hole in the foil, right adjacent to the part of the foil that will flex into and out of the pressure equalization chamber.

In one embodiment, each ink passage may be associated with two separate pressure equalization chambers, one of which serves as a damper in conjunction with the flow restriction, whereas the other one is arranged close to the outlet port and serves as a compliance system for buffering varying ink demands of the discharge units. In a specific embodiment, such a combination of a damper and compliance system is realized, for a four-color printer, with a sandwich structure including only three plate members with two foils interposed therebetween.

When only one pressure equalization chamber per ink cavity is required, the ink supply assembly according to the present invention can even be embodied as a sandwich structure with only two plate members and three foils, wherein the plate members have no undercuts, so that they may be formed by molding techniques and can easily be removed from the mold.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
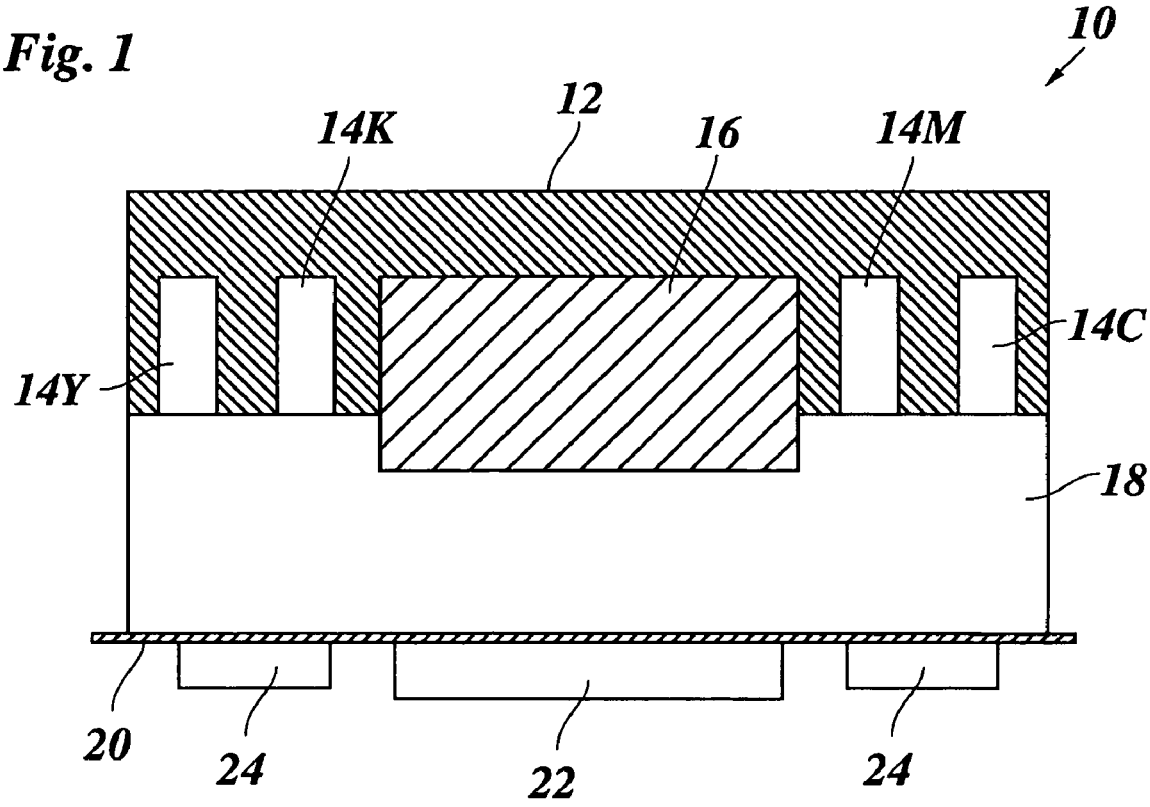
FIG. 1 is a cross-sectional view of a printhead to which the present invention is applicable.

The present invention will now be described with reference to the accompanying drawings, wherein the same reference numerals have been used to identify the same or similar elements throughout the several views.

FIG. 1 is a sectional view of an ink jet printhead that may be considered to extend across an entire width of a page of a recording medium in the direction normal to the plane of the drawing. The main support structure of the printhead is formed by a profiled bar 12 that defines four ink ducts 14Y, 14K, 14M and 14C, one for each color, that extend lengthwise of the beam and are open to the bottom surface thereof.

In this example, the printhead 10 is to operate with hot melt inks which have to be heated to a temperature of approximately 100° C. in order to be kept in a liquid state. This is why the beam 12 also defines a recess for accommodating a heating device 16.

An ink supply assembly of the printhead is formed by a sequence of ink distribution tiles 18 that are mounted on the bottom side of the beam 12 so as to embrace a part of the heating device and are arranged directly adjacent to one another so as to continuously cover the entire length of the beam 12. A lead structure 20, e.g. a printed circuit board, a flexboard or the like, is attached to the bottom surface of the ink distribution tile 18 and carries, on its bottom side, a continuous sequence of ink discharge units 22 as well as electronic drivers 24 for controlling the discharge units. Electric power and control signals for the discharge units 22 are supplied via the lead structure 20.

Figure 2:
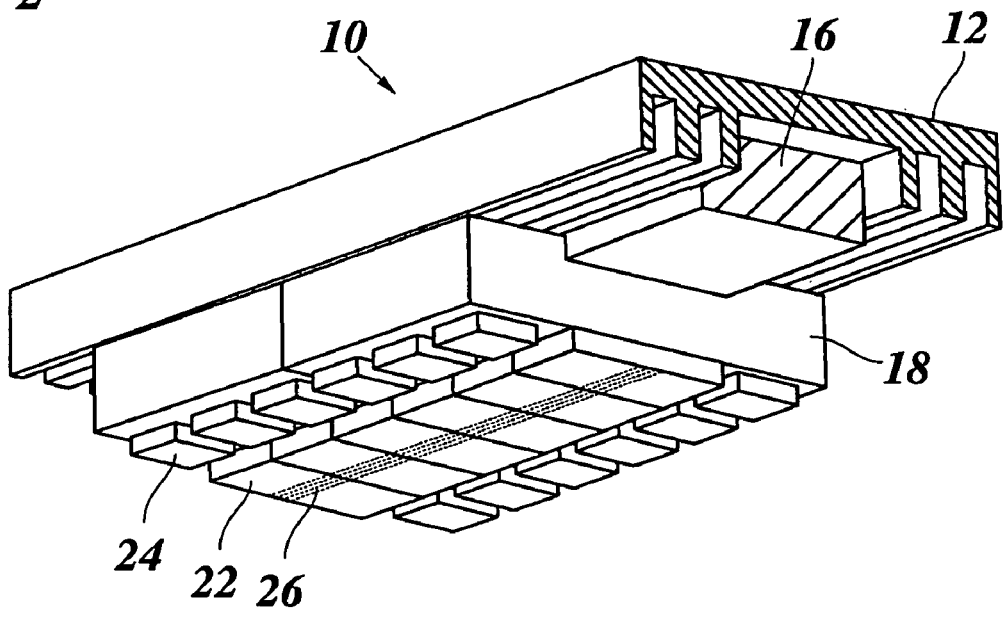
FIG. 2 illustrates, partly in section, the printhead of FIG. 1 in a perspective view from below.

As can be seen in FIG. 2, the discharge units 22 are configured as chips or tiles and are butted against one another so as to form a continuous row extending along the bottom of the printhead and to form four continuous nozzle lines 26, one for each color, with nozzles arranged with a uniform pitch. As can also be seen in FIG. 2, each ink distribution tile 18 carries a plurality of discharge units 22. The discharge units that are arranged adjacent to one another on neighboring tiles 18 are also butted against one another so as to provide a continuous pattern of nozzles. The discharge units 22 may be configured as micro-electromechanical systems (MEMS), for example.

Of course, a different tiling pattern of the discharge units 22 would also be possible. For example, the tiles could be trapezoidal or T-shaped and could be arranged with alternatingly inverse orientations, so that the tiles would overlap in a longitudinal direction of the printhead. Then, the parts of the nozzle lines 26 formed on each tile could be staggered in a transverse direction of the printhead, and the offsets would be compensated for by appropriately controlling the timings and which of the nozzles are fired.

The print resolution of the printhead 10 may be larger than the pitch of nozzles in the nozzle lines 26 and may for example be twice that pitch. By way of example, the print resolution may be as high as 300 dpi even when the pitch of the nozzles in each nozzle line 26 is only 150 nozzles per inch. To that end, the printhead 10, as a whole, is oscillated in a longitudinal direction by half the pitch. Due the mass of inertia of the liquid ink, such movements of the printhead may, however, induce pressure fluctuations or oscillations in the ink contained in the ink ducts and in the ink distribution tiles 18.

The main purpose of the ink distribution tiles 18 is to supply and distribute the ink of each color to the appropriate nozzles of the discharge units 22. Further, the ink supply system should have a certain compliance so as to be able to respond to varying demands for ink in the various regions of the printhead, without causing large variations in the velocity and pressure of the ink flows. Another purpose of the ink supply assembly according to this embodiment is to attenuate pressure fluctuations in the ink that may be induced by the oscillations of the printhead that have been mentioned above.

Figure 3:
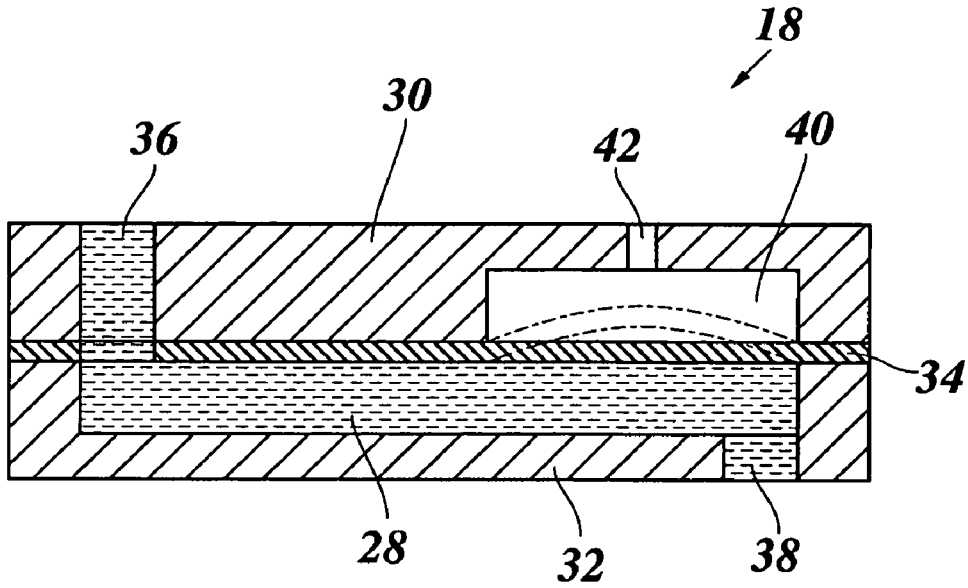
FIGS. 3 and 4 are schematic cross-sectional views illustrating function principles of the present invention.

The design concepts that are used for achieving these objectives will now be described in conjunction with FIGS. 3 and 4. FIG. 3 shows a schematic cross-section of an ink distribution tile 18 that has only a single ink passage 28 for ink of one color. The tile 18 has a sandwich structure formed by a rigid upper plate member 30, a rigid lower plate member 32 and a thin polyimide film 34 interposed therebetween.

An inlet port 36 for the ink is formed in the upper plate member 30 so as to be connected to one of the ink ducts 14Y, 14K, 14M, 14C. An outlet port 38 is formed in the lower plate member 32 for being connected to one of the discharge units 22. The ink passage 28 is formed by a recess in the top surface of the lower plate member 32 that is covered by the foil 34 and is in communication with the inlet port 36 via a through-hole in the foil 34. At the downstream end of the ink passage 28, the upper plate member 30 has a recess in its lower surface, and this recess defines a pressure equalization chamber, designated as "compliance chamber" 40, that is separated from the ink passage 28 by a part of the foil 34. The compliance chamber 40 is open to the atmosphere through a vent hole 42 and, consequently, is always kept under atmospheric pressure.

When the liquid ink in the ink passage 28, especially at the downstream end thereof, is subject to pressure fluctuations, e.g. because the demand for ink in the pertinent discharge unit 22 has decreased suddenly, so that the flow of ink through the passage 28 has to be stopped against the force of inertia of the liquid ink, the foil 34 may flex into the compliance chamber 40 in order to absorb the pressure fluctuation, as has been indicated in phantom lines in FIG. 3. Conversely, when the demand for ink at the outlet 38 increases suddenly, the foil 34 may flex into the opposite direction. Thus, the compliance chamber 40 always acts to smoothen-out fluctuations in the pressure and ink flow in the ink passage 28.

It will be appreciated that the compliance chamber 40 is integrated in the sandwich structure of the ink distribution tile 18 and does not increase the space requirement for this tile.

It should be observed here that ink passages that are partly bounded by a flexible membrane are generally known in ink jet printers, namely in the ink discharge unit, and are frequently employed for creating pressure pulses in the ink for the purpose of generating ink drops. In contrast, the structure that is proposed in this application is provided upstream of the ink discharge unit and is integrated in the ink distribution assembly for the purpose of smoothening the pressure in the liquid ink.

Figure 4:
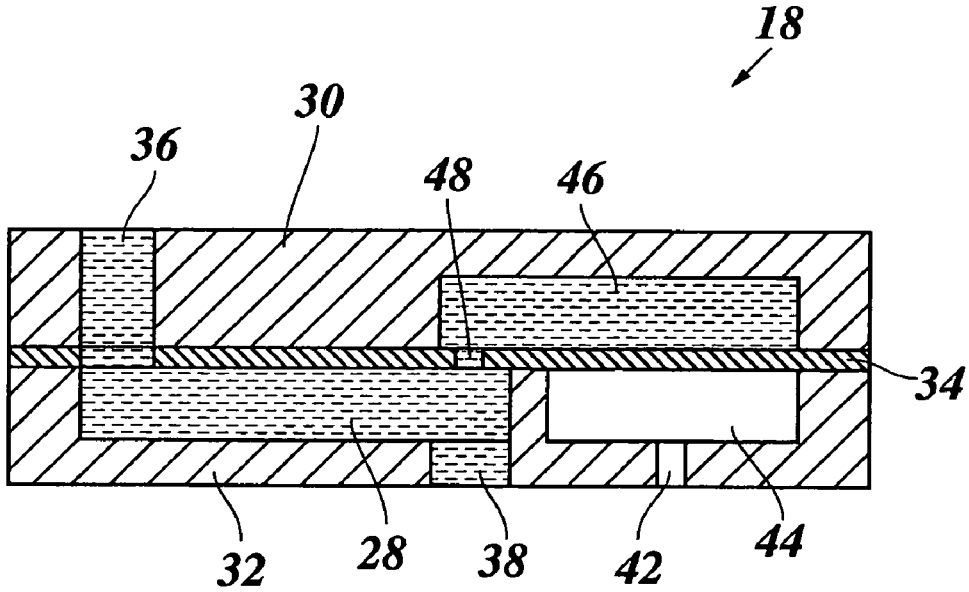

FIG. 4 shows another possible configuration of the ink distribution tile 18. Here, a vented pressure equalization chamber, which will briefly be termed "air chamber" 44 hereinafter, is formed in the lower plate member 32 and is separated from the ink passage 28 by a rigid wall. The upper plate member 30 forms an ink chamber 46 that is opposed to the air chamber 44 and is separated therefrom by a part of the foil 34. The ink chamber 46 and the ink duct 28 are in communication with one another via a through-hole 48 in the foil 34. The ink chamber 46 is filled with liquid ink, although, considering the flow of ink from the inlet 36 to the outlet 28, it forms a dead end. Nevertheless, when pressure fluctuations or oscillations occur in the ink passage 28, a part of the liquid ink will flow into or out of the ink chamber 46 through the through-hole 48 and will flex the part of the foil 34 separating the ink chamber 46 from the air chamber 44. The term "ink cavity" shall be used hereinafter for the combination of the ink chamber 46 and the ink passage 28.

The through-hole 48 forms a flow-restriction that increases the flow resistance to be overcome by the liquid flowing into and out of the ink chamber 46. Thus, a part of the energy of the pressure oscillations is dissipated at the flow restriction, and by suitably dimensioning this flow restriction, the flow resistance may be adjusted such that pressure oscillations in a predominant frequency range are damped critically. For example, the flow restriction may be adjusted to the frequency of oscillations that are induced by the oscillating movement that is imparted to the printhead 10 in order to increase the print resolution thereof.

Having thus described the general principles of the present invention, a more specific first embodiment example will now be described with reference to FIGS. 5-13.

Figure 5:
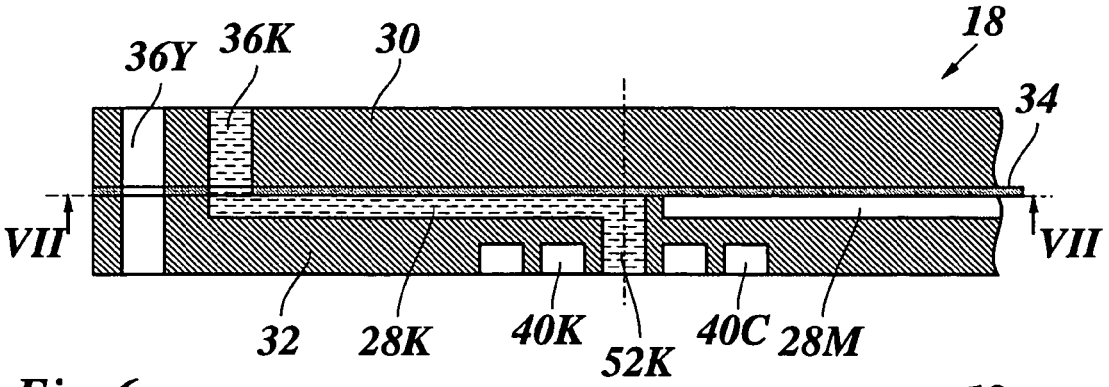
FIGS. 5 and 6 are cross-sectional views of parts of an ink supply assembly according to a first embodiment of the present invention, the sections being taken along the line V-V and VI-VI, respectively, in FIGS. 7 and 8.

The ink distribution tile 18 according to this embodiment has a sandwich structure composed of three plate members with thin foils interposed therebetween. FIG. 5 shows only the first or upper plate member 30, the second (central) plate member 32 and the foil 34 interposed therebetween.

Figure 6:
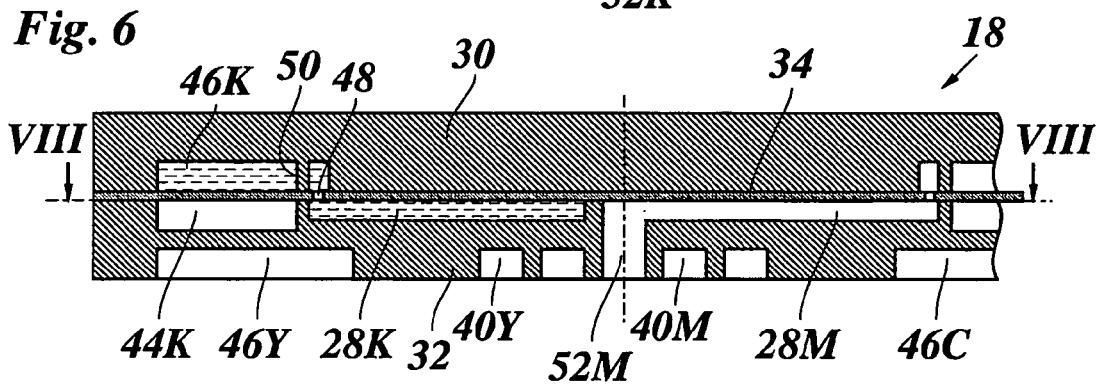
Figure 7:
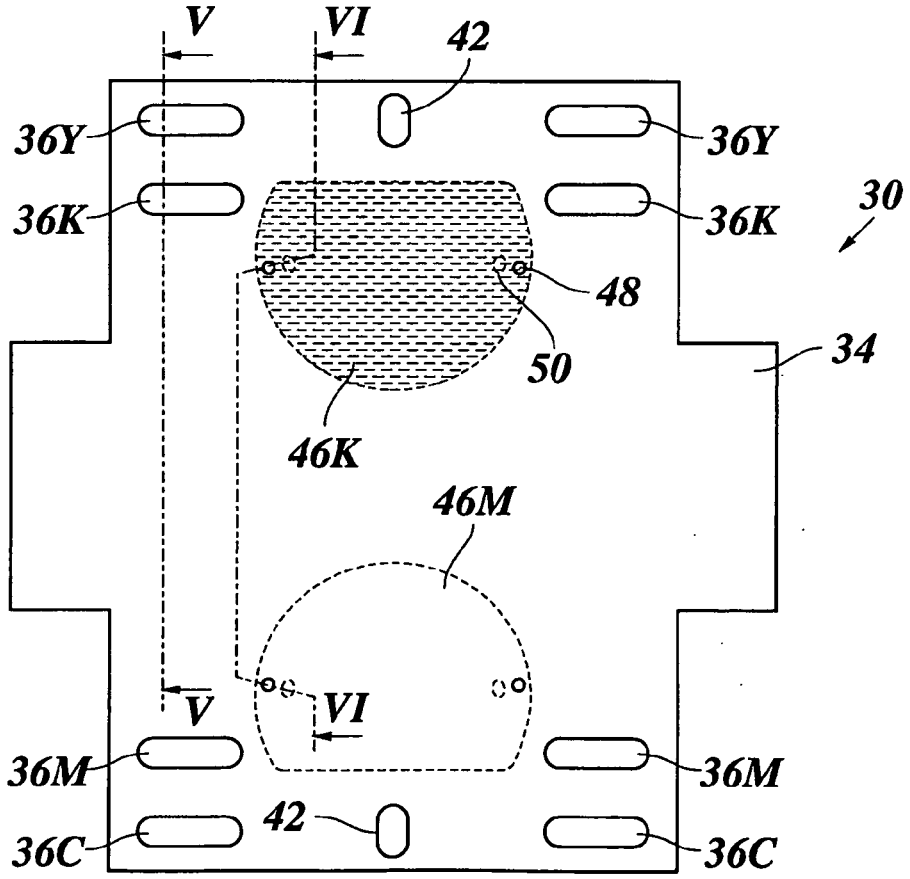
FIG. 7 is a bottom view onto the plane VII-VII in FIG. 5; showing a first foil and a first plate member.
Figure 8:
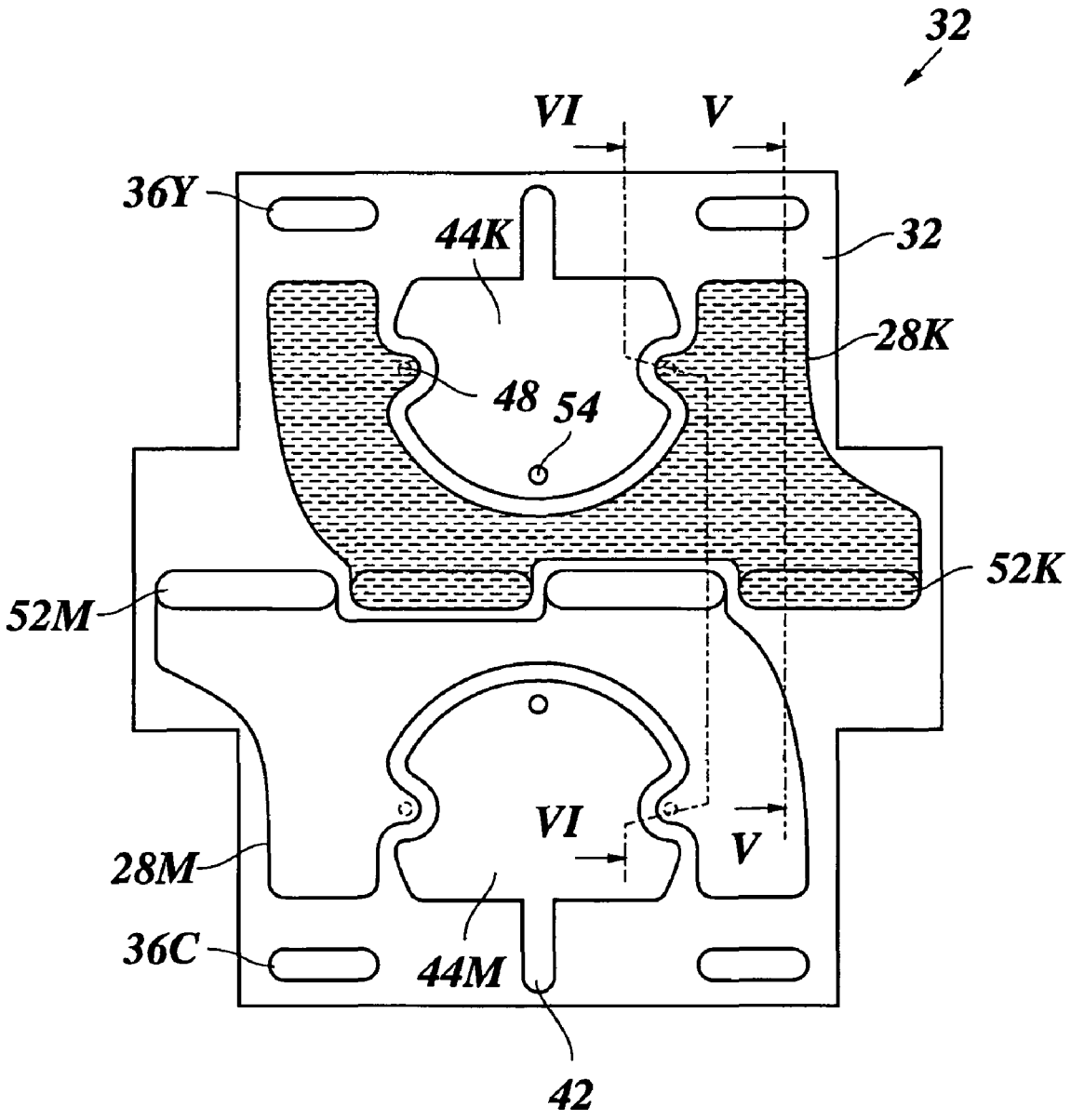
FIG. 8 is a top view onto the plane VIII-VIII in FIG. 6, showing a top surface of a second plate member.

FIG. 6 is a sectional view of the same components of the tile 18, but taken at another sectional plane, as has been indicated in FIGS. 7 and 8.

FIG. 7 shows the entire first foil 34 in a view from below and also shows (in phantom lines) the structures on the bottom side of the first plate member 30 that are hidden by this foil.

As is best shown in FIG. 7, the first plate member 30 and the foil 34 form two symmetrically arranged inlet ports 36Y for yellow ink, two inlet ports 36K for black ink and, at the opposite end of the tile, two inlet ports 36M and 36C for ink of magenta and cyan, respectively. As a general rule, in this description, suffixes Y, C, M and K behind a reference number will indicate the color of the ink in the supply system to which the item indicated by the reference number belongs.

Vent holes 42 are formed through the first plate member 30 and the first foil 34.

An ink chamber 46K for black ink is formed in the bottom side of the first plate member 30 and is covered by the foil 34. In this ink chamber, the foil is supported by two islands 50 in the vicinity of through-holes 48.

Another ink chamber 46M for ink of magenta is also formed in the bottom surface of the first plate member 30 and has a configuration mirror-symmetric to that of the ink chamber 46K. The through-hole 48 and the island 50 of the ink chamber 46K are also shown in the sectional view in FIG. 6.

FIG. 8 shows the top surface of the second plate member 32. Ink passages 28K and 28M are connected to the inlet ports 36K and 36M, respectively, and are formed by recesses in the top surface of the plate member 32 that are symmetric under a 180° rotation. On the downstream side, each of the ink passages 28K, 28M is connected to two slot-like ports 52K, 52M that are open to the bottom surface of the plate member 32. The ports 52K and 52M are arranged alternatingly on the central axis of the tile.

Each of the ink passages 28K, 28M surrounds an air chamber 44K, 44M that is essentially congruent with a respective one of the ink chambers 46K and 46M from which it is separated by the foil 34 (FIG. 6). The through-holes or flow restrictions 48 that connect the ink passages to their respective ink chambers are formed in bay portions of the ink passages 28K, 28M that project into the air chambers, as is shown in FIG. 8.

Each of the air chambers 44K, 44M is connected to one of the vent holes 42 that have been shown in FIG. 7 and is open to the bottom side of the plate member 32 via another vent hole 54.

Figure 9:
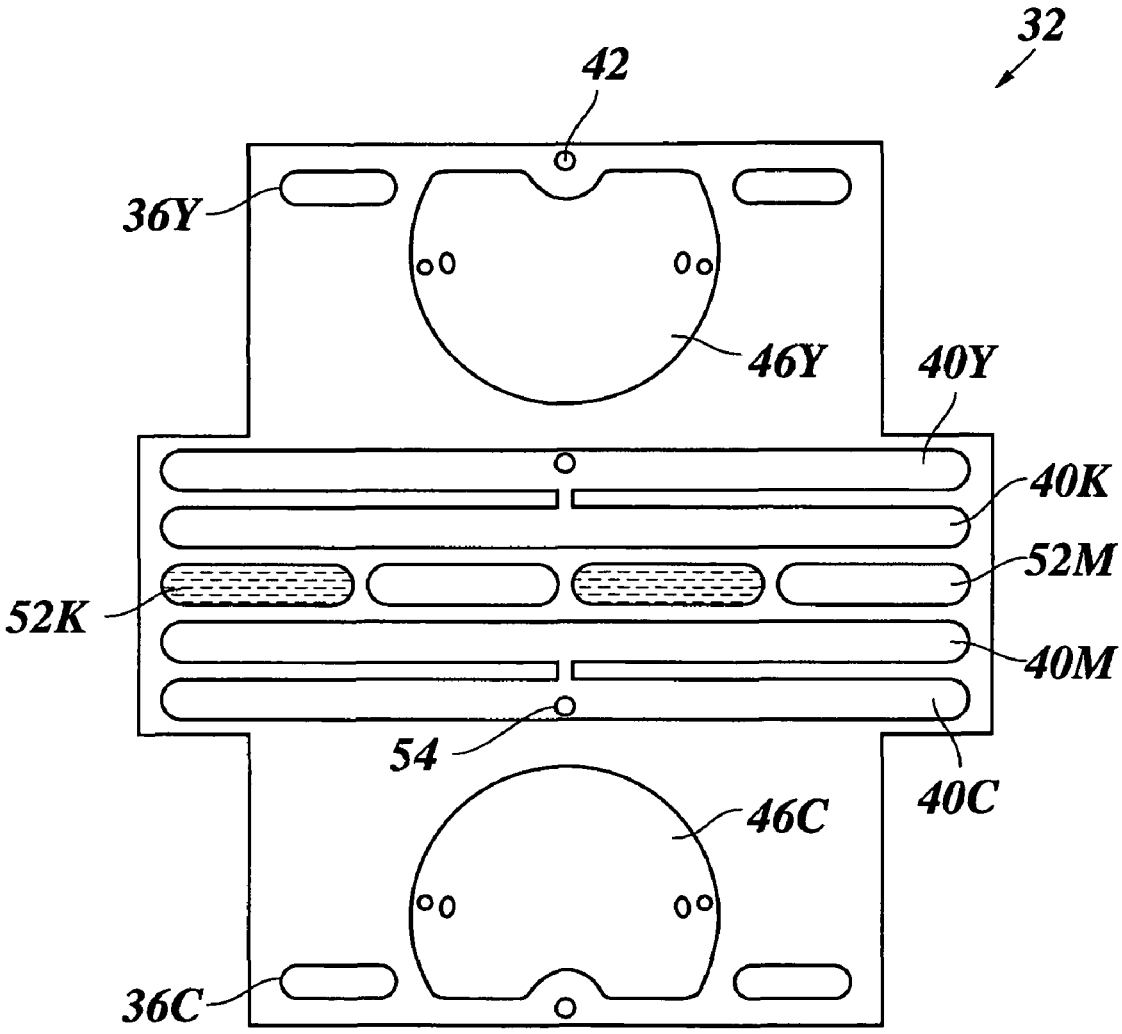
FIG. 9 is a bottom view onto the plane IX-IX in FIG. 12, showing the bottom surface of the second plate member.

FIG. 9 is a bottom view of the second plate member 32 that is penetrated by the inlet ports 36Y and 36C, by downward extensions of the vent holes 42 and by the slot-like ports 52K and 52M (whose left/right positions are inverted because one now looks at the bottom surface of the plate member). Recesses in the bottom surface of this plate member form ink chambers 46Y and 46C that have the same configuration as the ink chambers 46K and 46M in FIG. 7, with the only difference being that they are slightly offset towards the outer edges of the tile.

Additional recesses in the bottom surface of the second plate member 32 form four elongated compliance chambers 40Y, 40K, 40M and 40C that extend in parallel with the alternating line of ports 52K and 52M. The two compliance chambers formed on either side of the ports 52K, 52M are interconnected with one another and, via the vent holes 54, with the air chambers 44K and 44M on the top side of the plate member 32.

Figure 10:
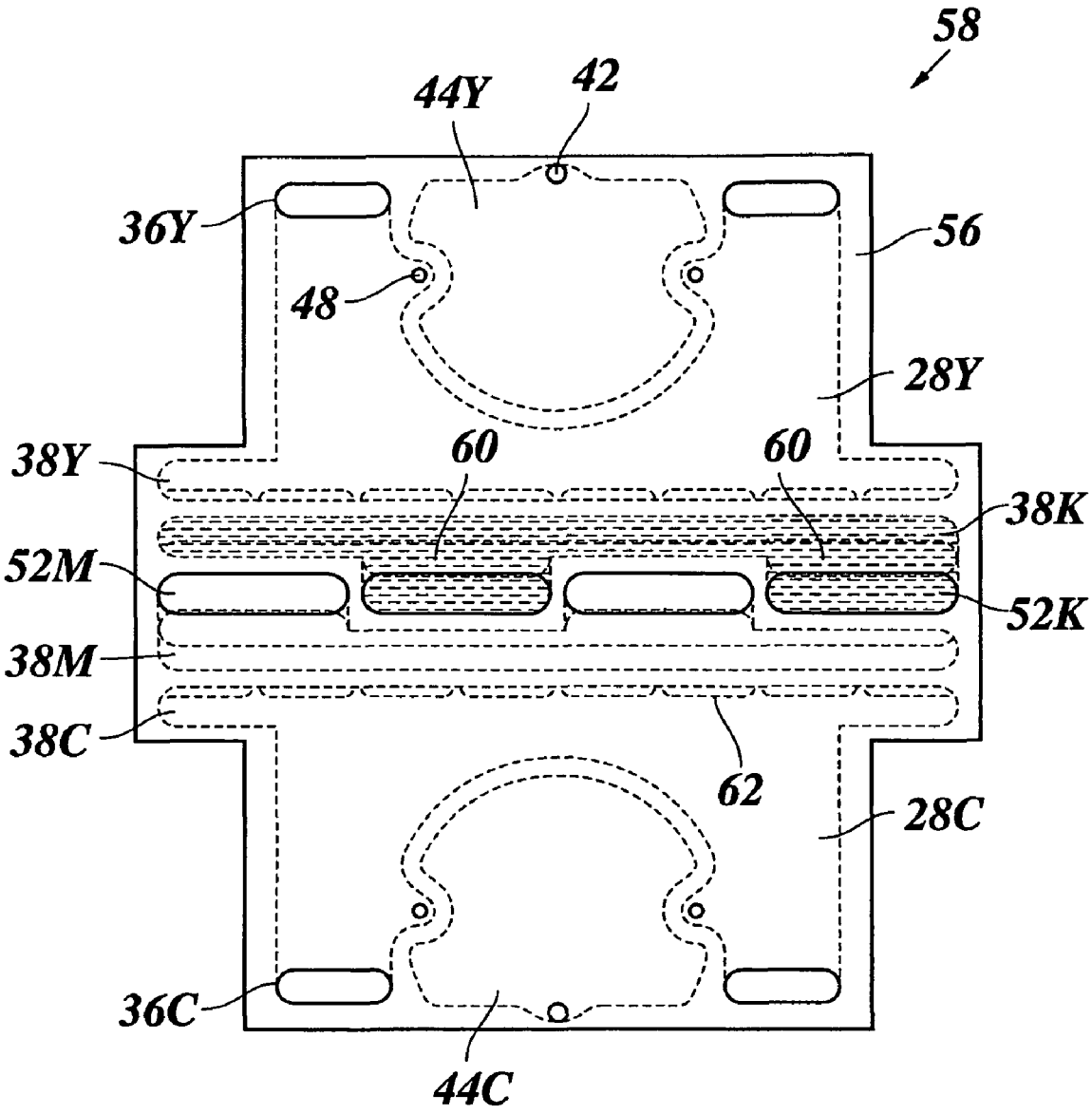
FIG. 10 is a top view onto the plane X-X in FIG. 12, which is identical with the plane IX-IX, but seen from an opposite side, showing a second foil and a top surface of a third plate member.
Figure 12:
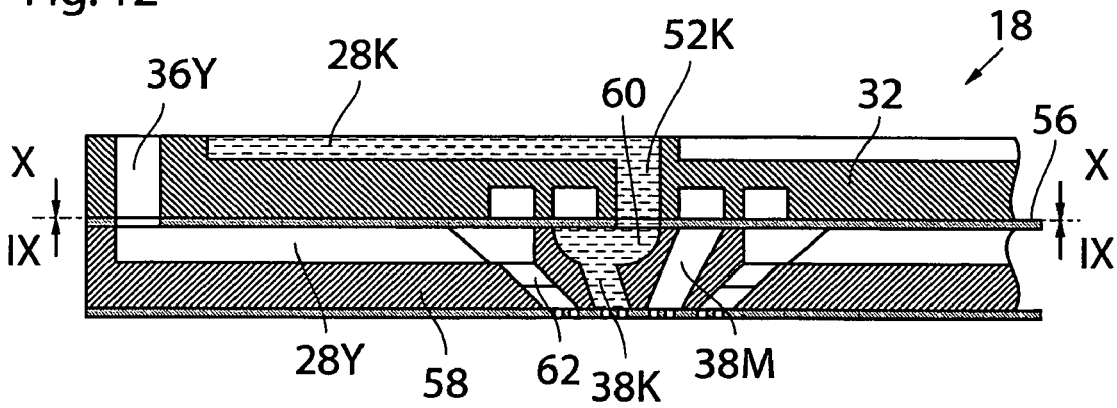
FIG. 12 is a sectional view of the second and third plate members along the line V-V in FIGS. 7 and 8.
Figure 13:
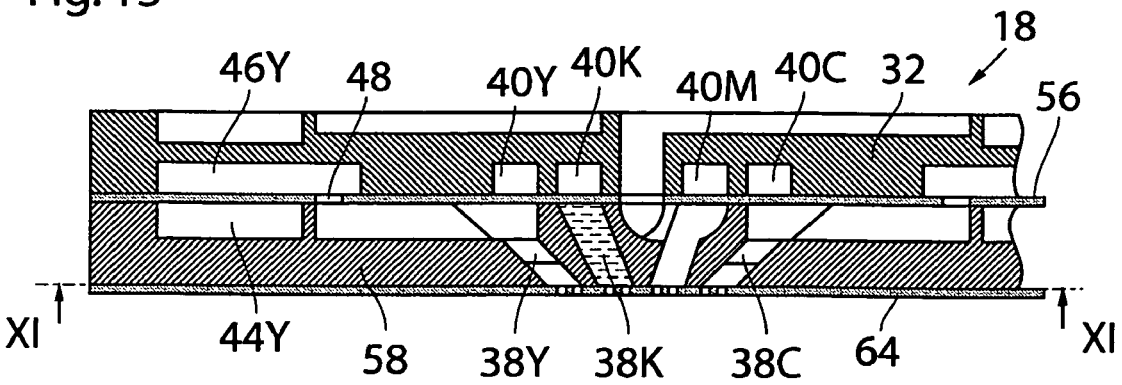
FIG. 13 is a sectional view of the second and third plate members along the line VI-VI in FIGS. 7 and 8.

The layer structure that has been described so far is disposed on a second foil 56 and a third plate member 58 that are not shown in FIGS. 5 and 6, but in FIGS. 12 and 13. FIG. 10 is a top plan view of the second foil 56 and shows also (in phantom lines) the structures of the third plate member 58 that are hidden by that foil. The foil 56 is penetrated by the inlet ports 36Y and 36C, through-holes 48, and the ports 52K and 52M. These latter ports are in communication, via slanting passages 60, with elongated outlet ports 38K and 38M that pass through the third plate member 58.

The top surface of the plate member 58 forms ink passages 28Y and 28C that connect the inlet ports 36Y, 36C to elongated outlet ports 38Y and 38C that pass through the plate member 58 and extend in parallel with the outlet ports 38K and 38M. Further, the through-holes 48 in the foil 56 connect the ink passages 28Y and 28C to the ink chambers 46Y and 46C, respectively, that are formed in the bottom surface of the second plate member 32 (FIG. 9).

Figure 11:
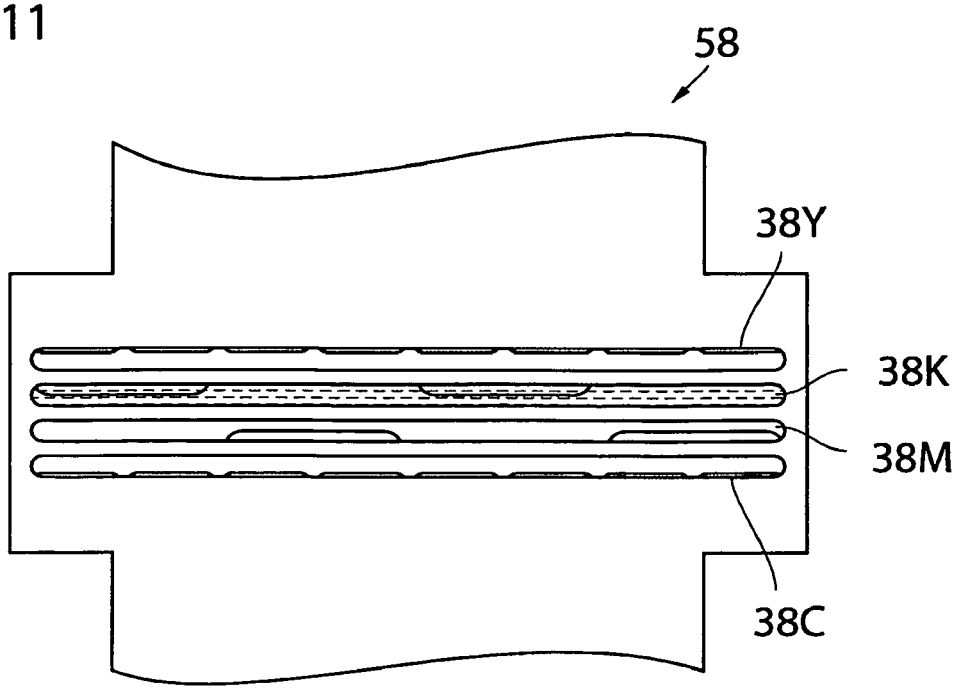
FIG. 11 is a bottom view onto the plane XI-XI in FIG. 13, showing the bottom surface of the third plate member.

FIG. 11 is a bottom view of the central part of the third plate member 58 and shows the four outlet ports 38Y, 38K, 38M and 38C, which take the form of narrow parallel slots through which ink of all four colors are supplied to the discharge units 22 (FIG. 2) that are placed on this ink distribution tile 18.

FIG. 12 illustrates the path of black ink from the ink passage 28K via the port 52K formed in the second plate member 32 and the third foil 56 and, finally, through the outlet port 38K. The top part of this outlet port 38K is enlarged to form the two slanting passages 60 (see also FIG. 10), which connect to the ports 52K. By comparison, FIG. 13 shows the plate member 58 in a sectional plane offset from the slanting passages 60. The outlet port 38M for magenta ink has essentially the same configuration.

The outlet ports 38Y and 38C for yellow and cyan slant downwardly from the respective ink passage 28Y, 28C and are connected thereto via a sequence of small windows 62 (FIGS. 10 and 12), whereas they are continuous in their lower parts.

The mouths of the outlet ports in the lower surface of the plate member 58 are covered by a perforated foil 64 which helps to smoothen-out any possible disturbances in the flow of ink that may be caused by the separating walls between the windows 62 and the inclined passages 60, respectively.

As is shown in FIG. 13, each of the compliance chambers 40Y, 40C extends right above the corresponding outlet port 38Y, 38C, so that varying demands of ink of the discharge units 22 can be buffered efficiently. Further, as is shown on the left side in FIG. 13, the ink chamber 46Y and the air chamber 44Y are separated by the second foil 56 and, together with the flow-restricting through-hole 48 interconnecting the ink chamber 46Y and the ink passage 28Y, are effective to attenuate pressure oscillations in the yellow ink. The ink chamber 46C and the air chamber 44C as well as the ink chambers 46K, 46M and air chambers 44K, 44M on opposite sides of the second foil 34 have equivalent functions.

Although the ink chambers 46Y-C form dead ends in the ink flow paths, a certain circulation and gradual replacement of the ink contained therein is made possible by providing two through-holes 48 for each of these ink chambers.

The foils 34 and 56 used in this embodiment should, on the one hand, have a suitable strength and, on the other hand, have a sufficient resiliency in view of the damper and compliance functions and should be chemically inert. An example of a suitable material is polyimide resin.

The plate members 30, 32 and 58 may for example be formed of graphite that can suitably be machined by laser machining techniques or the like. This material has the advantage that is has a high thermal stability, good heat conductivity and a thermal expansion coefficient that matches with the one of the ink discharge units 22 when the latter are formed by silicon MEMS.

Figure 14:
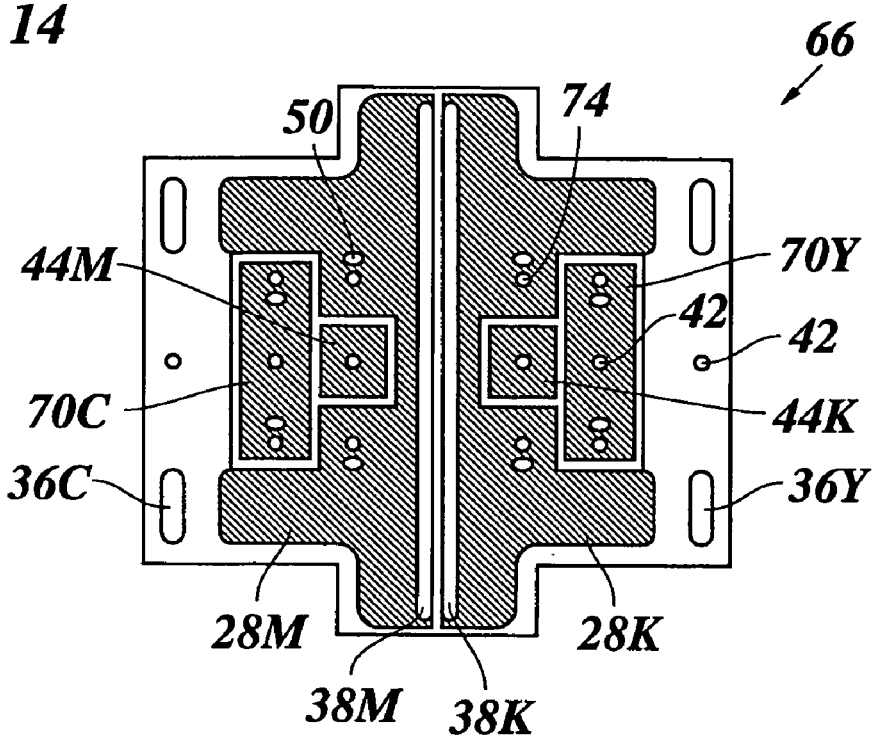
FIG. 14 is a top plan view of a first plate member of an ink supply assembly according to a second embodiment of the invention.
Figure 15:
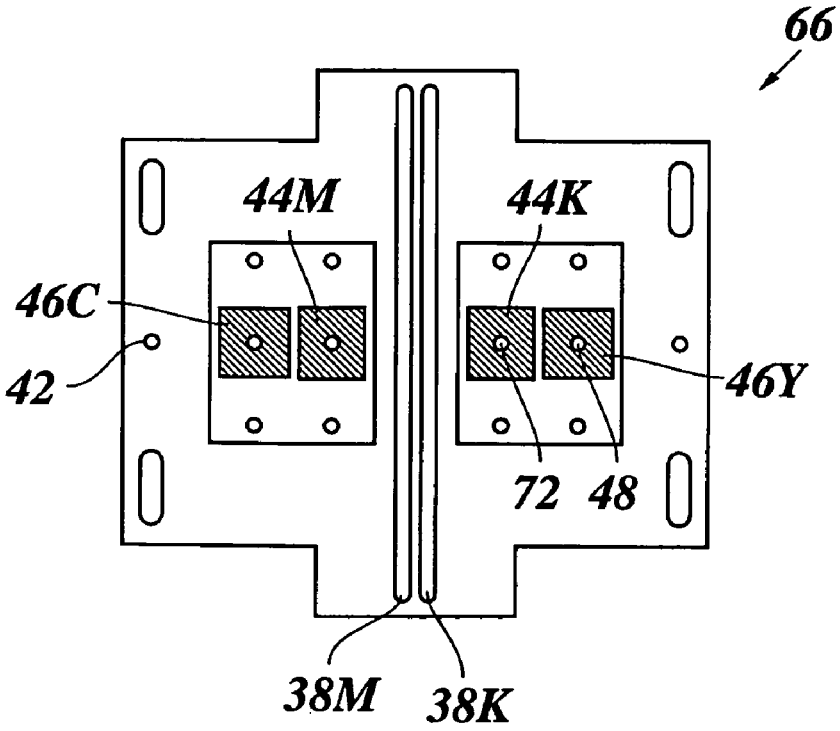
FIG. 15 is a bottom view of the first plate member shown in FIG. 14.
Figure 16:
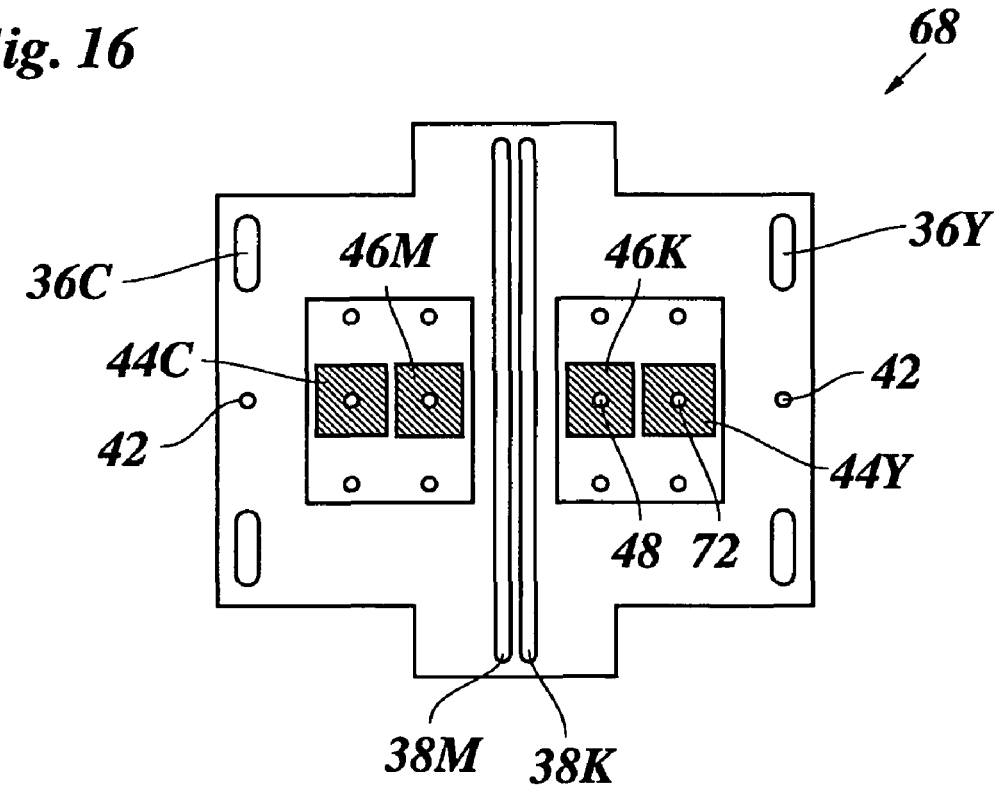
FIG. 16 is a top plan view of a second plate member of the ink supply assembly according to the second embodiment of the invention.
Figure 17:
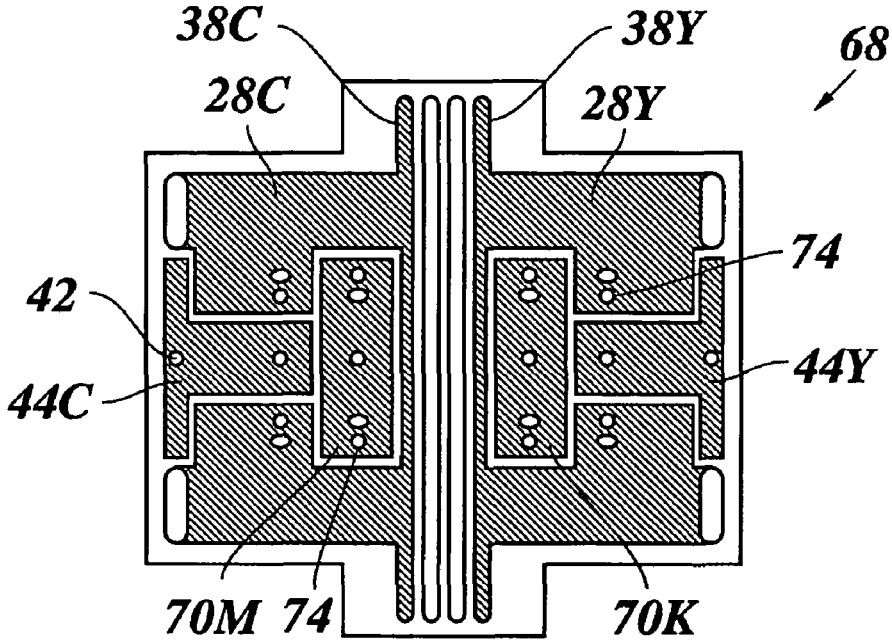
FIG. 17 is a bottom view of the second plate member shown in FIG. 16.

FIGS. 14 to 17 illustrate an ink distribution tile according to a second embodiment of the present invention. This tile is formed by a sandwich structure of plate members 66, 68 and polyimide foils (not shown) interposed therebetween and is disposed on the top and bottom of the structure. FIG. 14 is a top view of the top plate member 66, FIG. 15 is a bottom view thereof, FIG. 16 is top view of the second plate member 68, and FIG. 17 is a bottom view of the second plate member. In all these Figures, recessed portions are indicated as hatched areas.

As is shown in FIG. 14, the first plate member 66 has four through-holes serving as inlet ports 36Y and 36C for yellow and cyan ink. The foil (not shown) covering the top surface of this plate member 66 is formed with eight elongate through-holes of which four are aligned with the inlet ports 36Y, 36C and the other four are arranged in similar pattern as in FIG. 7 and directly serve as inlet ports for black and magenta inks. Through these inlet ports, the black and magenta ink enter into ink passages 28K and 28M, which are connected to slot-like outlet ports 38K, 38M which penetrate both plate members 66 and 68 and extend in parallel along the center line of the tile.

Separated from the ink passages 28K, 28M, the top surface of the plate member 66 defines first portions of air chambers 44K and 44M and connection chambers 70Y and 70C.

As is shown in FIG. 15, recessed portions in the bottom side of the plate member 66 form second portions of the air chambers 44K and 44M as well as ink chambers 46Y and 46C. The first and second portions of the air chambers 44K and 44M are connected to one another via through-holes 72 penetrating the first plate member 66. Similarly, through-holes 48 connect the connection chambers 70Y and 70C to their respective ink chambers 46Y and 46C.

The first portions of the air chambers 44K and 44M on the top surface of the plate member 66 are open to the atmosphere via through-holes formed in the foil that covers this plate member. Additional vent holes 42 pass through this foil, through the first plate member 66, the second foil (not shown) intervening between the two plate members, and the second plate member 68 and vent air chambers 44Y, 44C at the bottom surface of the second plate member 68.

As is shown in FIG. 16, the second plate member 68 is also penetrated by the inlet ports 36Y and 36C. Recessed portions in the top surface of this plate member 68 define ink chambers 46K and 46M which are in communication, via through-holes 48, with connection chambers 70K and 70M formed in the bottom surface of the second plate member 68, as is shown in FIG. 17. Aligned through-holes 74 of both plate members 66, 68 establish a communication between the connection chambers 70K, 70M in FIG. 17 and the ink passages 28K and 28M in FIG. 14. As is further shown in FIGS. 14 and 17, the foils covering the top surface of the plate member 66 and the bottom surface of the plate member 68 are supported by islands 50 in the vicinity of the through-holes 74.

Black ink that has entered into the ink passage 28K will enter into the connection chamber 70K and from there, via the flow-restricting through-hole 48, into the ink chamber 46K formed in the top surface of the plate member 68. This ink chamber 46K is congruent with and opposed to the air chamber 44K on the bottom side of the plate member 66 (FIG. 15), and the ink chamber and the air chamber are separated by the flexible foil interposed between the two plate members. Thus, pressure fluctuations in the black ink can be attenuated similarly as in the first embodiment.

The same holds true for the magenta ink introduced into the ink passage 28M.

The ink in yellow and cyan that has entered through the inlet ports 36Y and 36C (FIG. 14) will be introduced into ink passages 28Y and 28C formed in the bottom surface of the second plate member 68 (FIG. 17), from where they will enter into slot-like outlet ports 38Y and 38C. The foil (not shown) covering the bottom surface of the plate member 68 will close the ink passages 28Y and 28C but will leave open the outlet ports, so that the ink of all four colors may be supplied to the ink discharge units.

From the ink ducts 28Y and 28C, the ink may also flow, via aligned through-holes 74, into the connecting chambers 70Y, 70C (FIG. 14) and from there into the ink chambers 46Y and 46C (FIG. 15). These ink chambers are opposed to second portions of the air chambers 44Y and 44C that communicate with first portions of these air chambers formed in the bottom surface of the second plate member 68 (FIG. 17). These first portions of the air chambers 44Y, 44C are vented through the vent holes 42. Thus, oscillations in the yellow and cyan ink can be attenuated in the same manner as oscillations in the black and magenta ink.

In the second embodiment, the air chambers 44Y-44C provide also for the necessary compliance of the ink supply system.

Due to the described configuration of the plate members 66, 68, it is possible to mold these plate members from polymeric or ceramic materials, for example.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink supply assembly, comprising:

at least one inlet port;

at least one outlet port adapted to be connected to an ink discharge unit of an ink jet device;

an ink cavity, said ink cavity comprising:

an ink passage that connects the inlet port to the outlet port; and an ink chamber in communication with the ink passage via a flow restriction and forming a dead end in the ink flow;

a sandwich structure formed by at least two plate members and a foil that is interposed therebetween and has a part forming a wall of said ink cavity, wherein at least one of said plate members defines a pressure equalization chamber adjacent to the ink cavity and separated therefrom by said foil, the pressure equalization chamber is a gas-filled chamber, and the foil separates the ink chamber from the pressure equalization chamber.

2. The assembly according to claim 1, wherein a first pressure equalization chamber is disposed adjacent to a downstream end of the ink passage and is separated therefrom by said foil, and a second pressure equalization chamber is disposed opposite to said ink chamber.

3. The assembly according to claim 1, wherein the flow restriction is formed by a through-hole in the foil.

4. The assembly according to claim 1, further comprising a plurality of ink passages for ink of different colors, wherein at least one pressure equalization chamber is associated with each ink passage.

5. The assembly according to claim 4, wherein the outlet ports connected to the different ink passages are configured as parallel slots.

6. The assembly according to claim 4, wherein a first pressure equalization chamber, a second pressure equalization chamber and an ink chamber opposed to said second pressure equalization chamber and connected to the ink passage through a flow restriction are associated with each of the ink passages.

7. The assembly according to claim 1, further comprising:

a first plate member;

a second plate member;

a third plate member;

a first foil interposed between the first plate member and the second plate member; and a second foil interposed between the second plate member and third plate member, wherein at least one pressure equalization chamber and an ink chamber associated with one of the ink passages are disposed on opposite sides of the first foil, and at least one other pressure equalization chamber and ink chamber are disposed on opposite sides of the second foil.

8. The assembly according to claim 7, wherein the ink supply ports are formed in the first plate, the outlet ports are formed in the third plate member, and each of at least two ink passages that are disposed adjacent to the first foil are connected to their outlet ports via at least two elongated ports formed in the second plate member, the elongated ports of the at least two ink passages being aligned with one another and arranged alternatingly.

9. The assembly according to claim 4, wherein at least one first ink passage is formed in a first plate member and connected to an outlet port that penetrates an adjacent second plate member and a foil interposed between the two plate members, at least one second ink passage is formed in the second plate member and connected to inlet ports that penetrate the first plate member and said foil, a first ink chamber is connected to the first ink passage and is formed in the second plate member adjacent to said foil, a first pressure equalization chamber is formed in the first plate member adjacent to said foil and opposed to said first ink chamber, a second ink chamber is connected to the second ink passage and formed in the first plate member adjacent to said foil, and a second pressure equalization chamber is formed in the second plate member adjacent to said foil and opposed to said second ink chamber.

10. An ink jet printer comprising:

an ink supply assembly, said ink supply assembly comprising:

at least one inlet port;

at least one outlet port adapted to be connected to an ink discharge unit of an ink jet device;

an ink cavity, said ink cavity comprising:

an ink passage that connects the inlet port to the outlet port; and an ink chamber in communication with the ink passage via a flow restriction and forming a dead end in the ink flow;

a sandwich structure formed by at least two plate members and a foil that is interposed therebetween and has a part forming a wall of said ink cavity, wherein at least one of said plate members defines a pressure equalization chamber adjacent to the ink cavity and separated therefrom by said foil, the pressure equalization chamber is a gas-filled chamber, and the foil separates the ink chamber from the pressure equalization chamber.

11. The ink jet printer according to claim 10, wherein said ink supply assembly is composed of a plurality of separate ink distribution tiles having an identical construction and arranged in a row so as to supply ink to at least one continuous nozzle line extending over the plurality of tiles.

12. The assembly according to claim 1, wherein the gas-filled chamber is an air chamber.

13. The assembly according to claim 12, wherein the air chamber is open to an atmosphere through a vent hole.

14. The ink jet printer according to claim 10, wherein the gas-filled chamber is an air chamber.

15. The ink jet printer according to claim 14, wherein the air chamber is open to an atmosphere through a vent hole.

16. An ink supply assembly, comprising:

at least one inlet port;

at least one outlet port adapted to be connected to an ink discharge unit of an ink jet device;

an ink cavity, said ink cavity comprising:

an ink passage that connects the inlet port to the outlet port; and an ink chamber in communication with the ink passage via a flow restriction and forming a dead end in the ink flow;

a sandwich structure formed by at least two plate members and a foil that is interposed therebetween and has a part forming a wall of said ink cavity, wherein at least one of said plate members defines a pressure equalization chamber adjacent to the ink cavity and separated therefrom by said foil, the pressure equalization chamber is a gas-filled chamber, and the foil separates the ink chamber from the pressure equalization chamber, and wherein the at least two plate members comprise at least a component selected from the group consisting of LCP (liquid crystal polymer), LTCC (low-temperature co-fired ceramic) and graphite.

* * * * *